US011635092B2

(12) United States Patent
Lim

(10) Patent No.: US 11,635,092 B2
(45) Date of Patent: Apr. 25, 2023

(54) ROTATING DEVICE

(71) Applicant: HANWHA POWER SYSTEMS CO., LTD, Changwon-si (KR)

(72) Inventor: Dong Hun Lim, Changwon-si (KR)

(73) Assignee: HANWHA POWER SYSTEMS CO., LTD, Changwon-si (KR)

( * ) Notice: Subject to any disclaimer, the term of this patent is extended or adjusted under 35 U.S.C. 154(b) by 134 days.

(21) Appl. No.: 17/032,199

(22) Filed: Sep. 25, 2020

(65) Prior Publication Data

US 2021/0131446 A1 May 6, 2021

(30) Foreign Application Priority Data

Oct. 30, 2019 (KR) ..... 10-2019-0136253

(51) Int. Cl.

| | |
|---|---|
| ***F04D 29/46*** | (2006.01) |
| ***F04D 29/56*** | (2006.01) |
| ***F04D 29/62*** | (2006.01) |
| ***F04D 17/10*** | (2006.01) |

(52) U.S. Cl.

CPC ..... *F04D 29/462* (2013.01); *F04D 29/563* (2013.01); *F05D 2240/12* (2013.01)

(58) Field of Classification Search

CPC ..... F01D 17/14; F01D 17/143; F01D 17/146; F01D 17/148; F01D 17/167; F01D 17/165; F01D 17/16; F01D 17/162; F01D 9/04; F01D 9/041; F02B 37/225; F05D 2220/40; F05D 2250/51; F05D 2240/12; F05D 2260/74; F05D 2260/76; F05D 2270/101; F04D 29/462; F04D 29/464; F04D 27/026; F04D 27/002; F04D 27/0246; F04D 29/284; F04D 29/287; F04D 29/46; F02C 7/042

See application file for complete search history.

(56) References Cited

U.S. PATENT DOCUMENTS

| | | | | |
|---|---|---|---|---|
| 9,243,648 | B2 * | 1/2016 | Clemons | F04D 29/462 |
| 9,840,934 | B2 * | 12/2017 | Christians | F01D 17/162 |
| 2010/0172745 | A1 | 7/2010 | Hodder | |

FOREIGN PATENT DOCUMENTS

| | | | |
|---|---|---|---|
| KR | 10-2012-0091427 | A | 8/2012 |
| KR | 10-2017-0102301 | A | 9/2017 |
| KR | 10-2018-0079641 | A | 7/2018 |

* cited by examiner

*Primary Examiner* — Eric J Zamora Alvarez

(74) *Attorney, Agent, or Firm* — Sughrue Mion, PLLC

(57) ABSTRACT

A rotating device includes a housing; a variable guide vane module provided on a surface of the housing; and a housing cover covering the variable guide vane module. The variable guide vane module includes a first module, which comprises a vane case that has a cylinder shape and that is provided in the housing, and further comprises a first link that is provided on the vane case; and a second module, which comprises a shroud case that is seated between the housing and the vane case, and further comprises a second link that is provided in the shroud case and is configured to be driven in accordance with driving of the first link. The variable guide vane module is configured to be separable into at least two modules, including the first module and the second module.

18 Claims, 19 Drawing Sheets

1

ROTATING DEVICE

This application is based on and claims priority under 35 U.S.C. § 119 to Korean Patent Application No. 10-2019-0136253, filed on Oct. 30, 2019, in the Korean Intellectual Property Office, the disclosure of which is incorporated by reference herein in its entirety.

BACKGROUND

1. Field

Embodiments of present disclosure relate to a rotating device, and more particularly, to a rotating device which can implement a variable guide vane (VGV) module having a vane having a flow control function for a compressor as a component and can thus facilitate the assembly/disassembly of the VGV module into/from a compressor.

2. Description of Related Art

In accordance with the demand for the development of high-performance, high-power electrical equipment, rotating devices such as generators and electric motors are provided. Examples of rotating devices include industrial compressors, pumps, or vehicular air supplies having a rotor-bearing structure.

A centrifugal compressor, in particular, is a device that compresses a fluid by applying a centrifugal force to the fluid with the use of an impeller that rotates.

The centrifugal compressor generally includes a driving unit, which produces a driving force, a gear unit, which is connected to the driving unit, a gear box in which the gear unit is installed, a rotating shaft, which is inserted in the gear box and is connected to the gear unit, and an impeller, which is connected to the rotating shaft to rotate and delivers rotational kinetic energy to a fluid to increase the pressure of the fluid, a scroll, which supports the impeller, and a shroud, which is coupled to the scroll to form an inner space in which the fluid can flow.

The air compressed by the impeller is guided to the scroll via a diffuser, which is disposed along the outer circumference of the impeller. The diffuser includes a plurality of vanes and releases compressed air to the scroll through the spaces between the vanes. The vanes of the diffuser are arranged along the circumference of the diffuser at intervals of a predetermined angle and can thus uniformly release air.

However, the need has arisen to control the amount of air being released, and there already exist techniques for controlling the angle of the vanes of the diffuser to control the amount of air being released.

FIGS. 1 through 4 illustrate a conventional guide vane module 1 including vanes 14.

In the conventional guide vane module 1, the vanes 14 are connected to a ring 13 to control the angle of the vanes 14, and the ring 13 is connected to the end of a rotating arm 12, which is connected to a linear actuator 11, to be rotatable. As the ring 13 rotates, the angle of the vanes 14 changes so that the amount of air that can pass through the spaces between the vanes 14 changes. However, since the ring 13 is connected to the end of the rotating arm 12, it is difficult to precisely control the degree of opening of the vanes 14. Also, since the rotating arm 12 is exposed on the outside of the conventional guide vane module 1 to be connected to the actuator 11, the size of the entire conventional guide vane module 1 may not be able to be reduced.

Also, due to the characteristics of a rotating device, particularly, a variable guide vane (VGV) module 2 equipped with a ring, parts that form a link are disposed on the side of a gearbox of an expander or a compressor, and an actuator and a link are disposed on the upper plate of the gear box, which is divided vertically. Thus, to disassemble the gearbox for maintenance or repair, the VGV module also needs to be disassembled, which inevitably takes a long time.

In addition, since elements provided in a diffuser are not implemented as individual modulates, it not only takes a long time to disassemble and assemble the VGV module for the maintenance or repair of the compressor, but also foreign materials are highly likely to infiltrate into, and remain stuck in, the gaps between elements on a flow path over time.

Moreover, as the tolerance of the gap between the vanes and the case of the VGV module increases depending on the stack/coupling structure of the VGV module, pressure loss may occur in the VGV module.

Furthermore, in the event of the occurrence of a failure in the VGV module, an examination of an internal link of the VGV module is needed. However, since the parts and elements of the VGV module are implemented as individual modules, the VGV module needs to be completely disassembled from the compressor to examine the link separately, which, however, is not only inconvenient, but also time-consuming. In addition, as the actuator is also disassembled, the link needs to be checked while being operated manually, which, however, is highly inconvenient.

SUMMARY

Embodiments of the present disclosure provide a rotating device in which parts and elements of a variable guide vane (VGV) module are implemented as individual modules and can thus be easily assembled or disassembled.

However, embodiments of the present disclosure are not restricted to those set forth herein. The above and other embodiments of the present disclosure will become more apparent to one of ordinary skill in the art to which the present disclosure pertains by referencing the detailed description of the present disclosure given below.

According to some embodiments, a rotating device is provided. The rotating device includes a housing; a variable guide vane module provided on a surface of the housing; and a housing cover covering the variable guide vane module, wherein the variable guide vane module comprises: a first module, which comprises a vane case that has a cylinder shape and that is provided in the housing, and further comprises a first link that is provided on the vane case; and a second module, which comprises a shroud case that is seated between the housing and the vane case, and further comprises a second link that is provided in the shroud case and is configured to be driven in accordance with driving of the first link, and wherein the variable guide vane module is configured to be separable into at least two modules, including the first module and the second module.

According to an embodiment, the first module and the second module are configured to be coupled to, or decoupled from, each other by a coupling.

According to an embodiment, the first link comprises: a main shaft, which is disposed in the housing in a first direction that is perpendicular to an extending direction of the vane case, a main link arm, which is coupled to the main shaft and extends in a second direction that is perpendicular to the first direction so as to be configured to rotate in accordance with rotation of the main shaft, a control arm, which is connected to the main link arm and extends in the second direction, and a pivot, which is provided at one end of the vane case and rotatably supports the control arm.

According to an embodiment, the main link arm comprises: a body, which is connected to the main shaft, and a slot, which extends in the second direction from the body.

According to an embodiment, the slot includes a recess that is open in the second direction so as to form an angular U shape.

According to an embodiment, the rotating device further comprises: a first rotation guide that is provided in the slot and is inserted in an input end of the control arm, the first rotation guide configured to be rotated by the main link arm.

According to an embodiment, the first rotation guide comprises: a first protrusion, which is provided within the slot, and a first rotating ball, which is formed around the first protrusion and allows a sliding rotation of the input end of the control arm.

According to an embodiment, the control arm comprises a body, and further comprises the input end and an output end which are provided at ends of the body, respectively, and the input end and the output end each include a rotation opening that couple to the slot and the second link, respectively.

According to an embodiment, the rotation opening of the input end and the rotation opening of the output end are open at the ends of the body of the control arm, and have a shape of symbols "⊃" and "⊂", respectively, when viewed in the first direction.

According to an embodiment, the second link comprises: a control ring, which is configured to rotate about the pivot in accordance with rotation of the main link arm, a plurality of vanes, which are connected to the control ring, the control ring configured to vary orientations of the plurality of vanes by rotating, and a link, which is provided between the control ring and the plurality of vanes and configured to deliver rotation of the control ring to the plurality of vanes.

According to an embodiment, at least one guide groove, in which an end of the main link arm is inserted, is formed between an outer circumferential surface and an inner circumferential surface of the control ring, and a second rotation guide is provided in a guide groove of the at least one guide groove and rotatably inserted in the output end of the control arm.

According to an embodiment, the second rotation guide comprises: a second protrusion, which is formed within the guide groove of the at least one guide groove, and protrudes from a surface of the guide groove, and a second rotating ball, which is formed around the second protrusion and allows rotation of the output end of the control arm.

According to an embodiment, the link comprises: a coupling, which is coupled to the plurality of vanes, and a slot, which extends in the second direction from the coupling.

According to an embodiment, the rotating device further includes a protruding pin provided on a surface of the control ring, the protruding pin protruding toward an inside of the shroud case and seated in the slot of the link.

According to an embodiment, at least one through hole is formed in the shroud case, the at least one through hole penetrated by the plurality of vanes such that the plurality of vanes are rotatably coupled the shroud case, and the rotating device further comprises at least one bushing provided between the at least one through hole and the plurality of vanes.

According to an embodiment, the rotating device further includes sliding pads provided on respective surfaces of an inner radial side of the control ring for the rotation of the control ring.

According to an embodiment, the output end of the control arm is configured to be provided around the second rotation guide such that the first link and the second link are interlocked, as the first module is inserted into the shroud case.

According to an embodiment, the rotating device further includes stoppers provided on the vane case on respective sides of the main link arm in directions perpendicular to the first direction and the second direction so as to be apart from each other, the stoppers configured to limit rotation of the main link arm.

According to an embodiment, an internal structure of the variable guide vane module and driving states of the first link and the second link are visible to an outside of the rotating device when the housing cover is separated from the housing.

According to one or more embodiments, a variable guide vane module is provided. The variable guide vane module includes: a first module, which comprises a vane case that has a cylinder shape, and further comprises a first link that is provided on the vane case; and a second module, which comprises a shroud case that is outside the vane case, and further comprises a second link that is provided in the shroud case and is configured to be driven in accordance with driving of the first link, and wherein the variable guide vane module is configured to be separable into at least two modules, including the first module and the second module.

Other features and embodiments may be apparent from the following detailed description, the drawings, and the claims.

BRIEF DESCRIPTION OF THE DRAWINGS

The above and other embodiments and features of the present disclosure will become more apparent by describing in detail embodiments thereof with reference to the attached drawings, in which.

DETAILED DESCRIPTION

Various changes may be made to embodiment of the present disclosure, and the present disclosure may have various embodiments which will be described in detail with reference to the drawings. However, the embodiments according to concepts of the present disclosure are not construed as limited to specified embodiments, and include all changes, equivalents, or substitutes that do not depart from the spirit and technical scope of the present disclosure.

The terms used in the present disclosure are for the purpose of describing particular example embodiments only and are not intended to be limiting. The singular forms are intended to include the plural forms as well, unless the context clearly indicates otherwise. The term "include" or "has" used in the present disclosure is to indicate the presence of features, numbers, steps, operations, elements, parts, or a combination thereof described in the specifications, and does not preclude the presence or addition of one or more other features, numbers, steps, operations, elements, parts, or a combination thereof.

All of the terms used herein including technical or scientific terms have the same meanings as those generally understood by an ordinary skilled person in the related art unless they are defined otherwise. The terms defined in a generally used dictionary should be interpreted as having meanings that are the same as or similar with the contextual meanings of the relevant technology and should not be interpreted as having ideal or exaggerated meanings unless they are clearly defined in the present disclosure.

Embodiments of the present disclosure will hereinafter be described with reference to the accompanying drawings.

Figure 1:
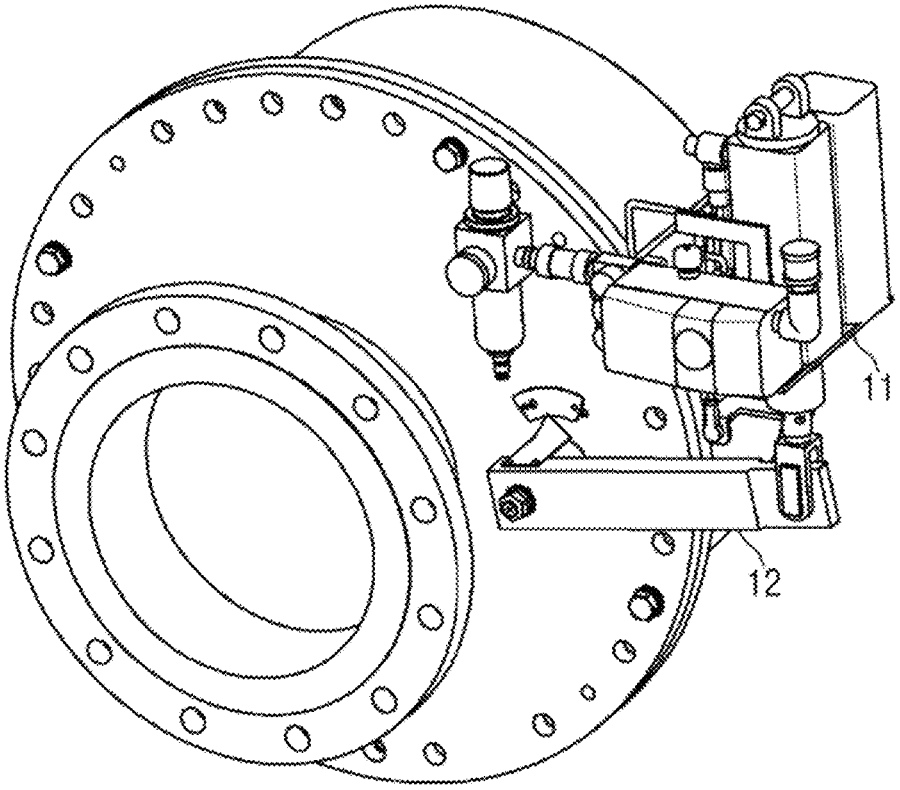
FIG. 1 is a perspective view of a conventional guide vane module.
Figure 2:
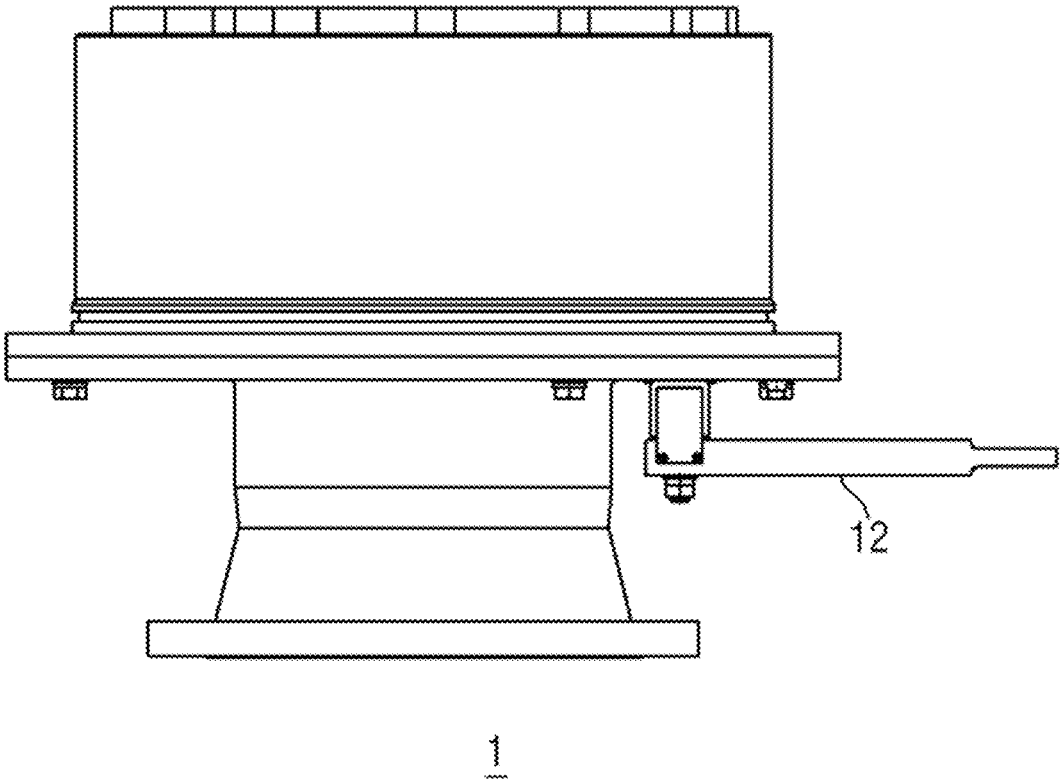
FIG. 2 is a plan view of the conventional guide vane module of FIG. 1.
Figure 3:
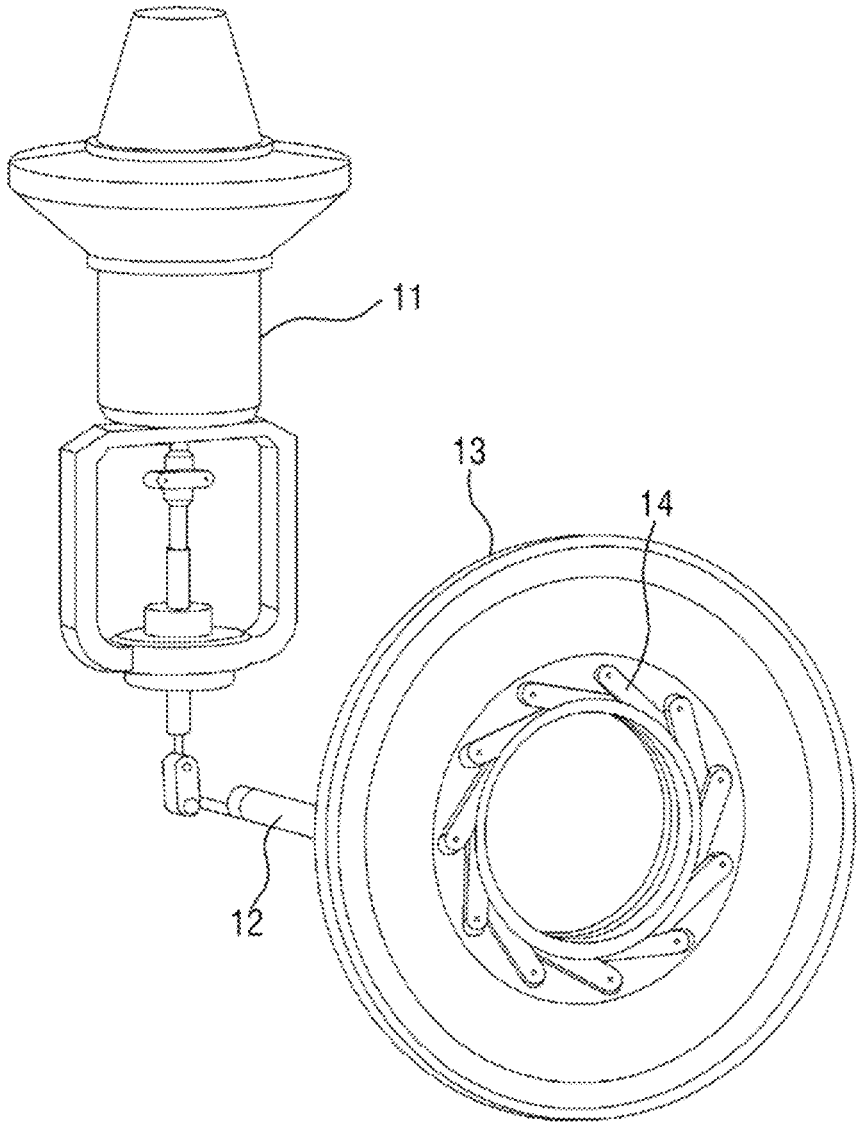
FIG. 3 is a perspective view illustrating a vane adjustment structure used in the conventional guide vane module of FIG. 1.
Figure 4:
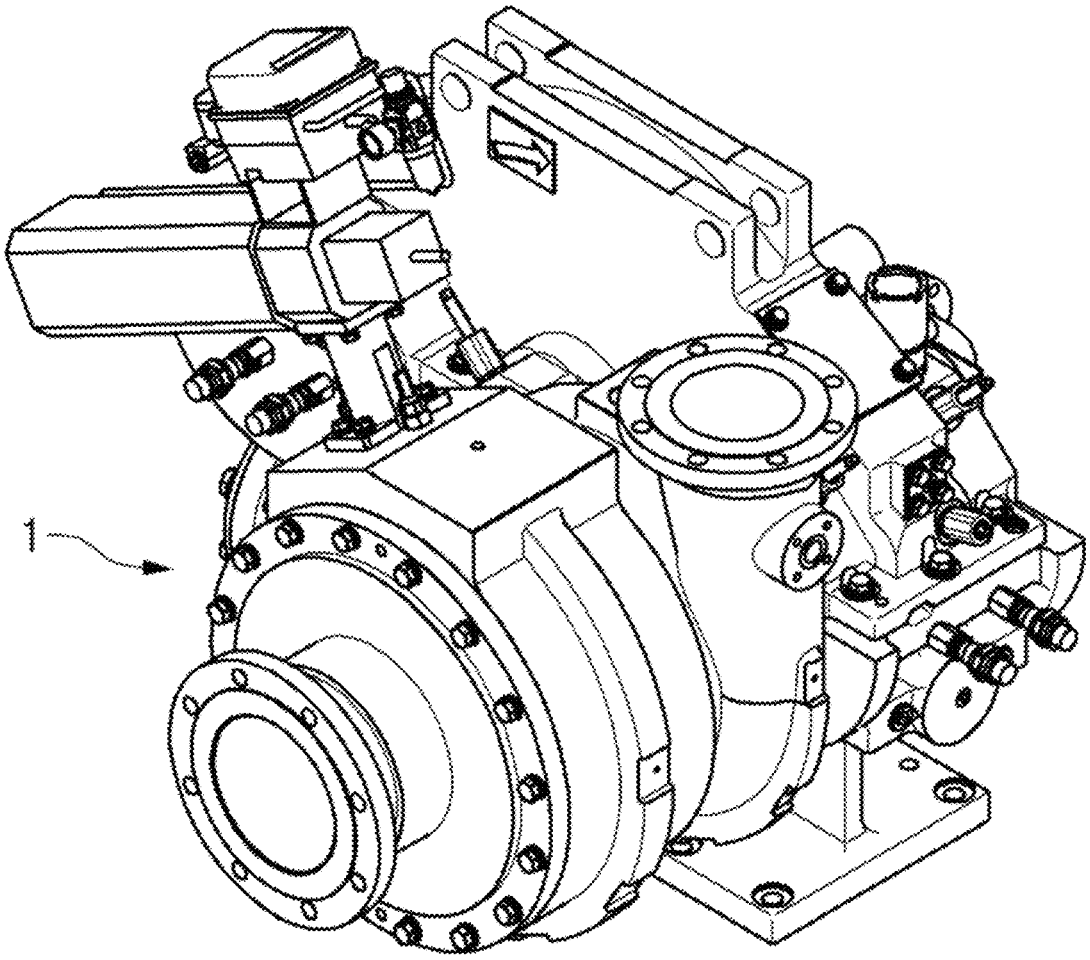
FIG. 4 is a perspective view illustrating the exterior of a compressor in which the conventional guide vane module of FIG. 1 is used.
Figure 5:
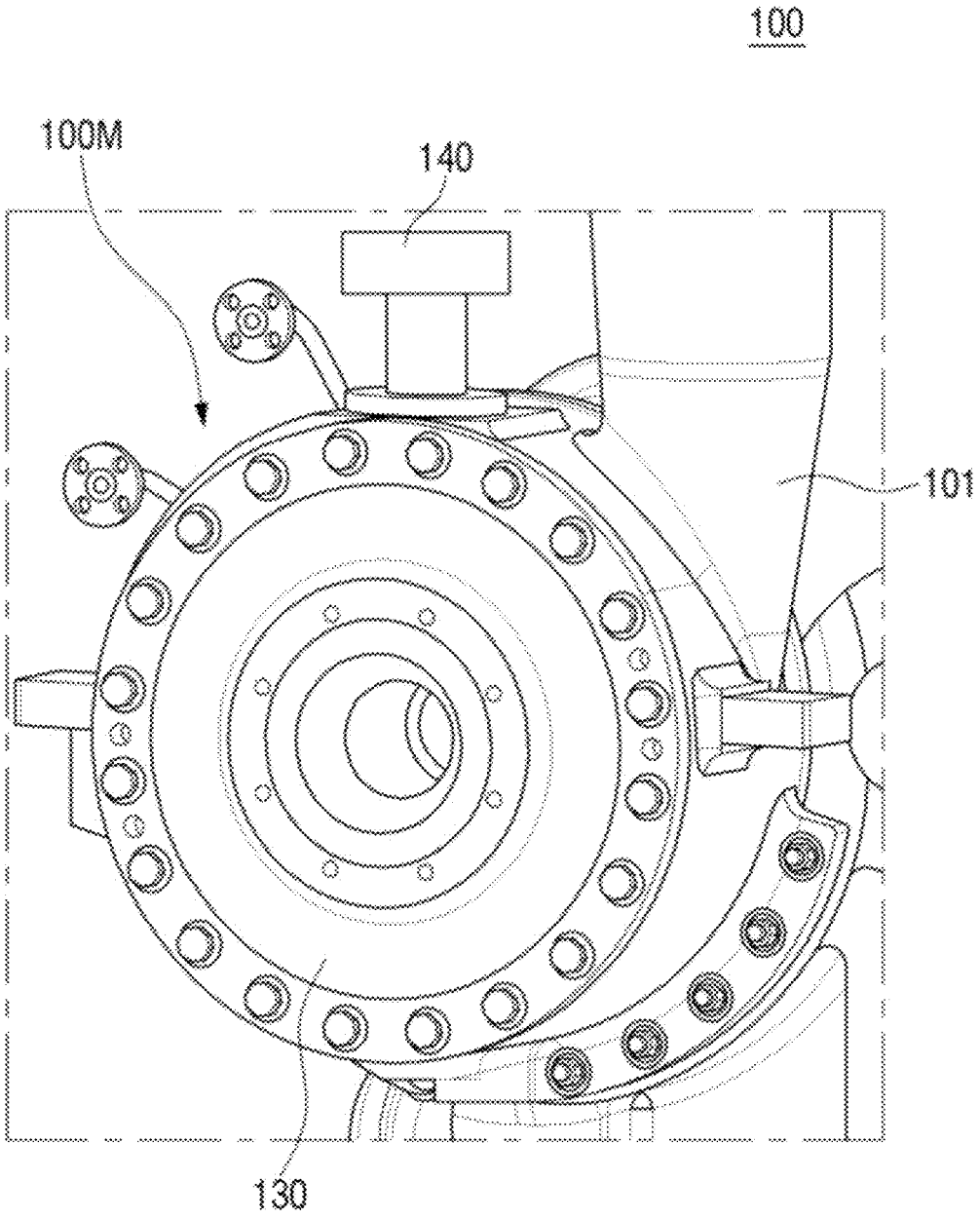
FIG. 5 is a perspective view illustrating a rotating device according to an embodiment of the present disclosure.
Figure 6:
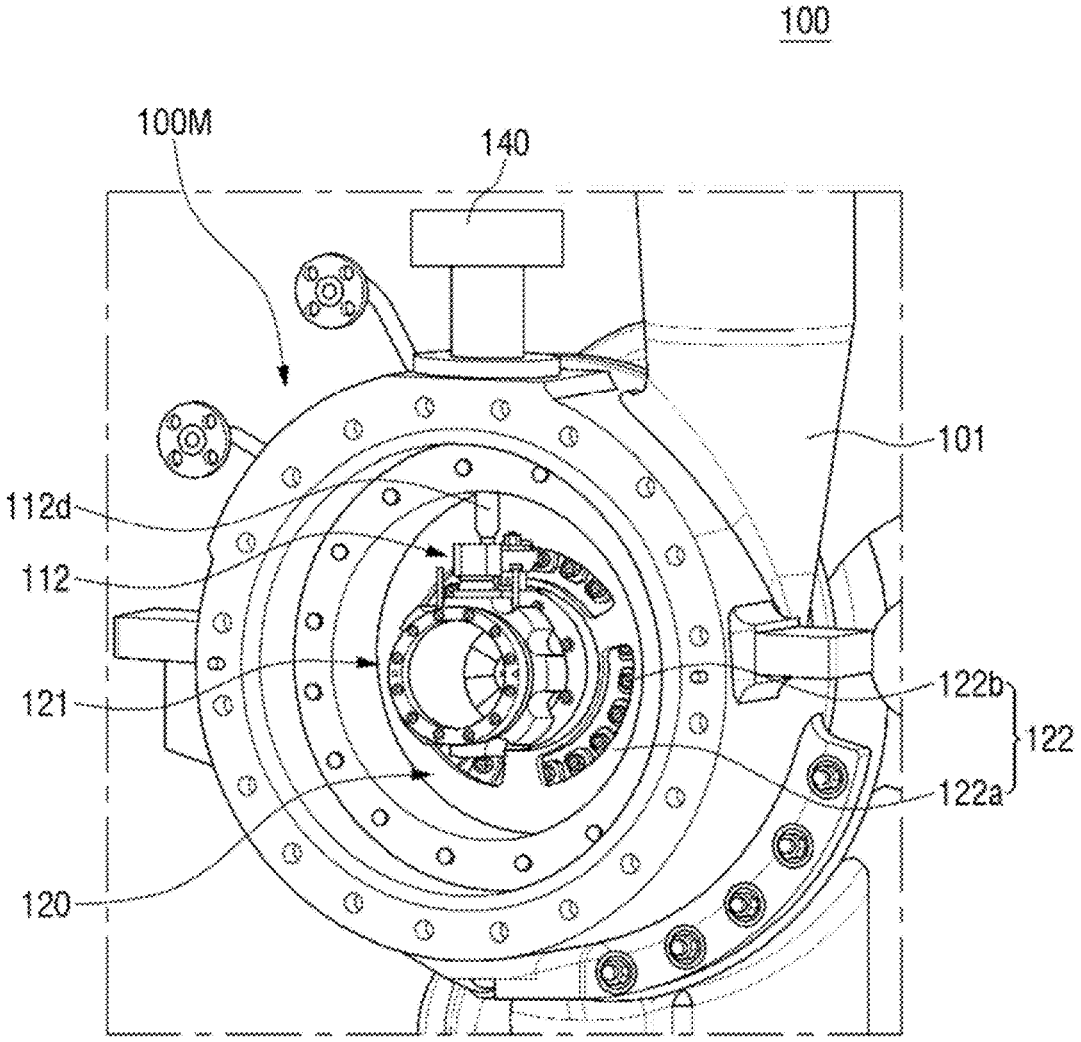
FIG. 6 is a perspective view illustrating how a variable guide vane (VGV) module of the rotating device according to an embodiment of the present disclosure with a housing cover separated therefrom is internally coupled.

FIG. 5 is a perspective view illustrating a rotating device 100 according to an embodiment of the present disclosure. FIG. 6 is a perspective view illustrating how a variable guide vane (VGV) module 100M of the rotating device 100 with a housing cover 130 separated therefrom is internally coupled.

Referring to FIGS. 5 and 6, the rotating device 100 may include a housing 101, a VGV module 100M, an actuator 140, and a housing cover 130. The VGV module 100M may be configured to comprise or consist of two separable modules that can be coupled together, and once the housing cover 130 is detached, the structure and the driving state of a link 122*c* (see, e.g., FIGS. 10-11 and 16A-B) of the VGV module 100M can be easily identified depending on how the actuator 140 is driven.

The VGV module 100M may be provided on a surface of the housing 101. For example, the VGV module 100M may be provided on both sides of the housing 101 or on only one side of the housing 101. The VGV module 100M is a structure that is connected to the actuator 140 to be driven in accordance with the driving of the actuator 140. The VGV module 100M may be divided into at least two modules that are separable from each other.

The housing cover 130 may be coupled to the housing 101 to cover a part where the VGV module 100M is mounted. As the housing cover 130 is opened at the housing 101, the driving state of the VGV module 100M may become identifiable.

The actuator 140 may be formed to penetrate the VGV module 100M in a direction perpendicular to the housing 101, on the inside of the housing 101. The actuator 140 may be coupled to the VGV module 100M, particularly, to a first link 112 of a first module 110, to provide a driving force for driving vanes 122*b*, which are provided in a second module 120.

The VGV module 100M, which is divided into two modules, will hereinafter be described.

Figure 7:
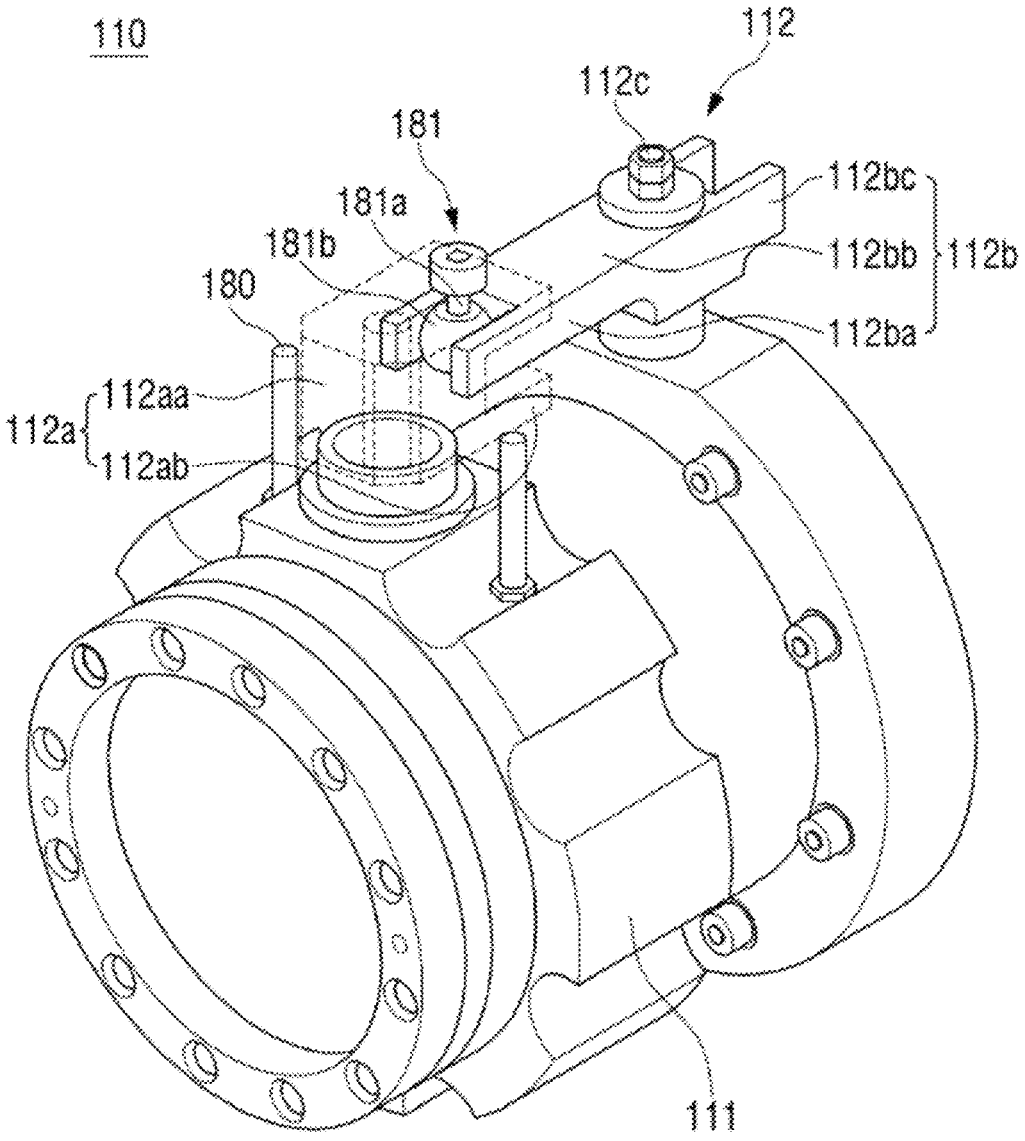
FIG. 7 is a perspective view illustrating a first module of the VGV module of FIG. 6.
Figure 8:
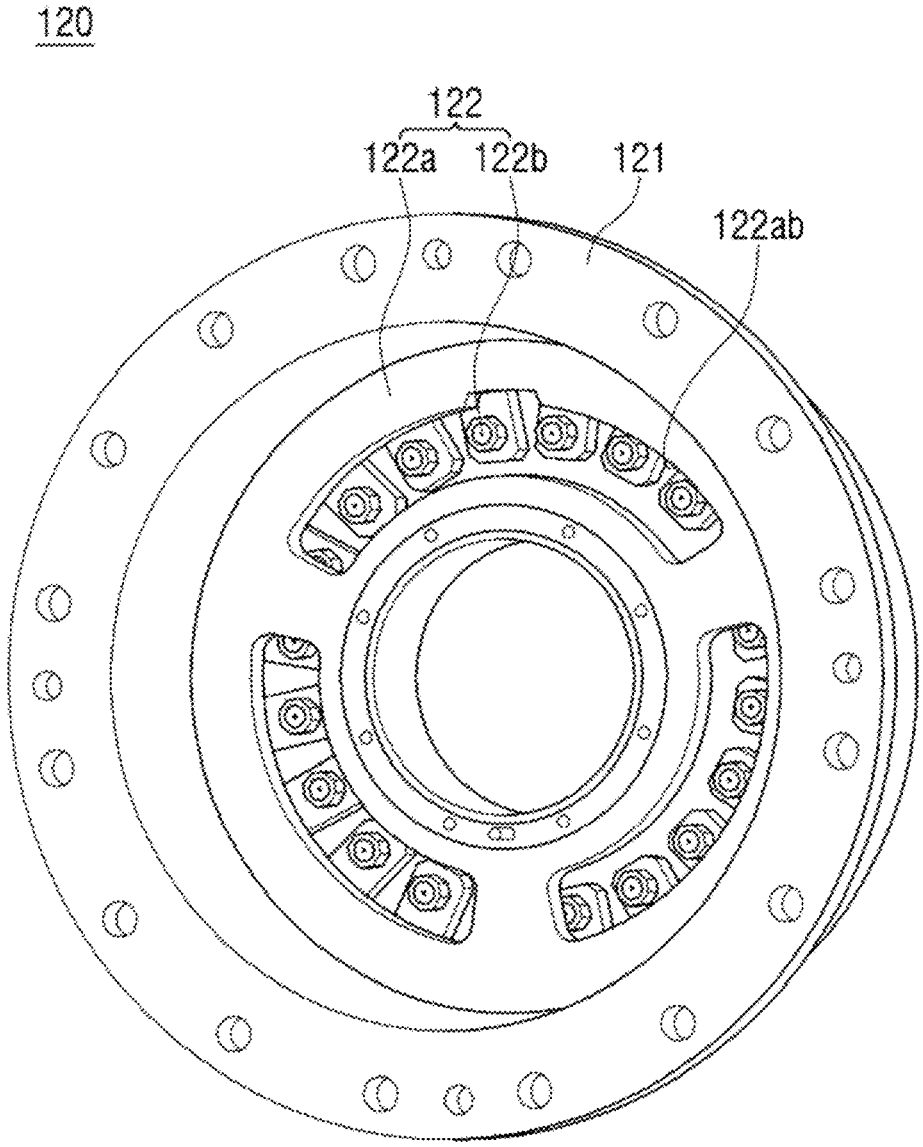
FIG. 8 is a perspective view illustrating a second module of the VGV module of FIG. 6.
Figure 9:
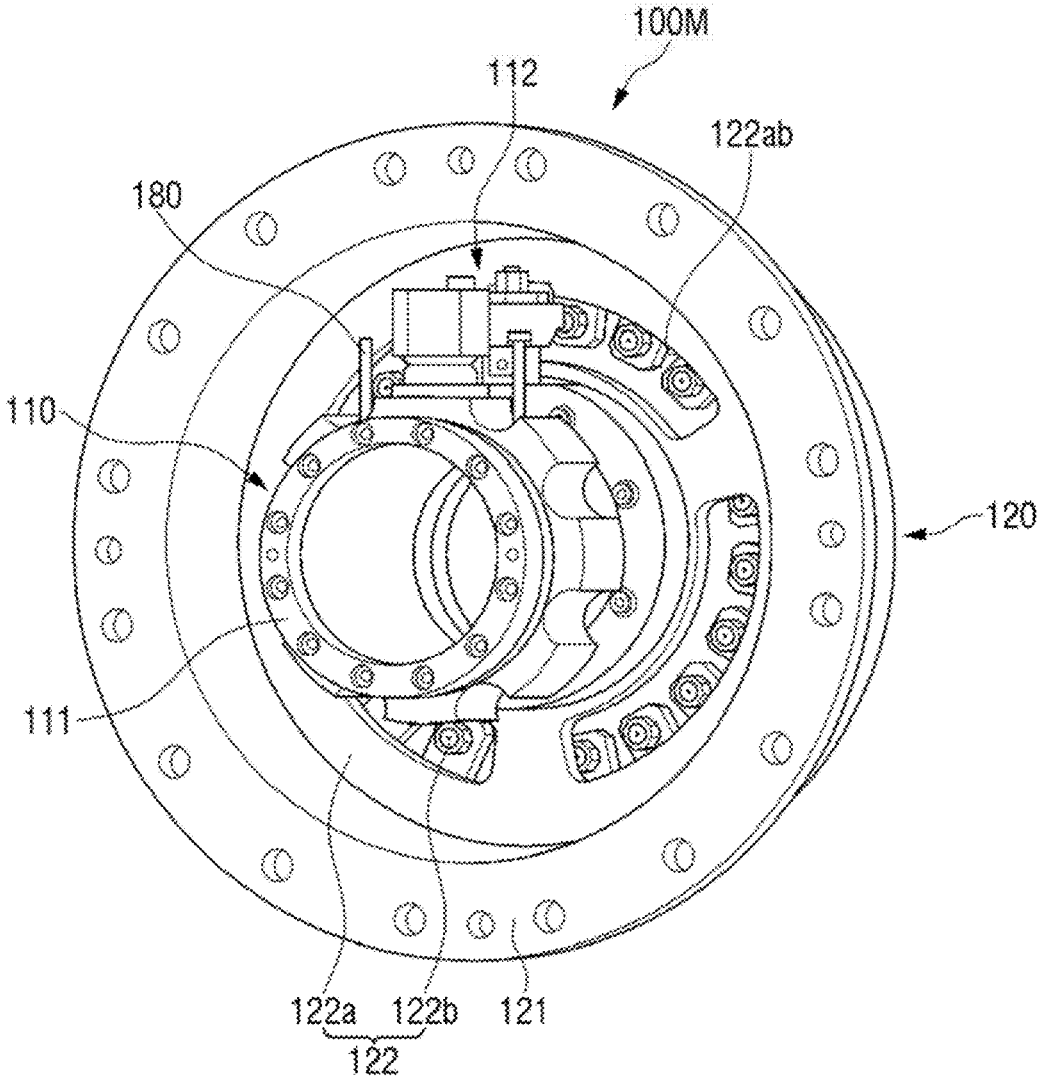
FIG. 9 is a perspective view illustrating how the first and second modules of FIGS. 7 and 8 are coupled.

FIG. 7 is a perspective view illustrating the first module 110 of the VGV module 100M. FIG. 8 is a perspective view illustrating the second module 120 of the VGV module 100M. FIG. 9 is a perspective view illustrating how the first and second modules 110 and 120 are coupled.

Referring to FIGS. 7 through 9, the VGV module 100M may include at least two modules, i.e., the first and second modules 110 and 120, and the first and second modules 110 and 120 may be configured to be detachable from each other.

The first and second modules 110 and 120 may be coupled to, or decoupled from, each other by a coupling. For example, the first module 110 may be inserted in the second module 120 and may be bolt-coupled to the second module 120.

The first module 110 may include a vane case 111 and the first link 112.

The vane case 111 may form a cylindrical hollow space in the middle thereof, and the first link 112 may be mounted on an upper side of the outer circumferential surface of the vane case 111, particularly, at a 12 o'clock position of the vane case 111. The actuator 140, which is for driving the first link 112, may be located in the 12 o'clock direction of the vane case 111.

The actuator 140 may be disposed on the outside of the vane case 111 to penetrate not only the housing 101, but also a shroud case 121 that will be described later.

The first link 112 may be provided on the outer circumferential surface of the vane case 111 in the 12 o'clock direction of the vane case 111 and may be connected to a second link 122 of the second module 120 to deliver the driving of the actuator 140 to the second link 122.

The second module 120 may form a hollow space therein and may have one surface open and another other surface inserted in the inside of the housing 101. The second module 120 may receive a driving force from the first link 112 and may mount therein a plurality of vanes 122*b* and a structure for rotating the vanes 122*b*.

The second module 120 may include the shroud case 121 and the second link 122.

The shroud case 121 may be seated between the housing 101 and the vane case 111. The shroud case 121 may be seated in the housing 101 and may be provided in a cylindrical shape to form a hollow space therein.

Once the housing cover 130 covers the housing 101, the hollow space in the shroud case 121 may be closed. A hole may be formed at the bottom of the shroud case 121. The second link 122, which is driven in accordance with the driving of the first link 112, may be provided in the shroud case 121. For example, some elements of the second link 122 (e.g., the link 122*c*) that are connected to the first link 112 may be formed on the inside of the shroud case 121, and other elements of the second link 122 (e.g., a control ring 122*a*) may be provided on the outside of the bottom of the shroud case 121.

The first and second modules 110 and 120, which are separate from each other, may be coupled together to form the VGV module 100M. Once the housing cover 130 is detached from the housing 101, the elements of each of the first and second modules 110 and 120 may become identifiable. The first and second modules 110 and 120 will hereinafter be described with reference to FIGS. 10 through 17.

Figure 10:
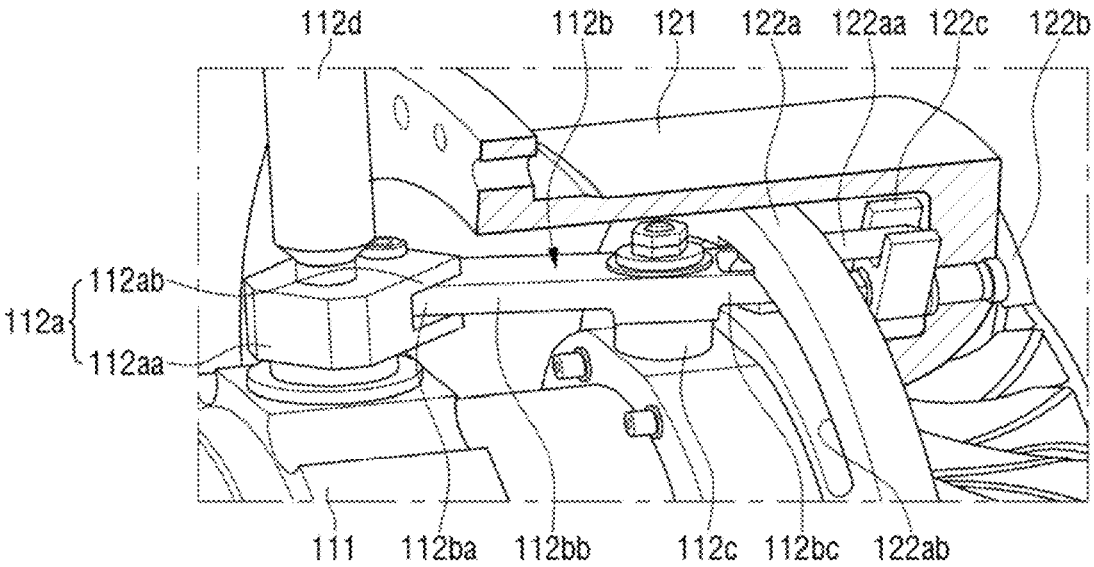
FIG. 10 is a partial perspective view illustrating how first and second links of the rotating device according to an embodiment of the present disclosure are coupled.
Figure 11:
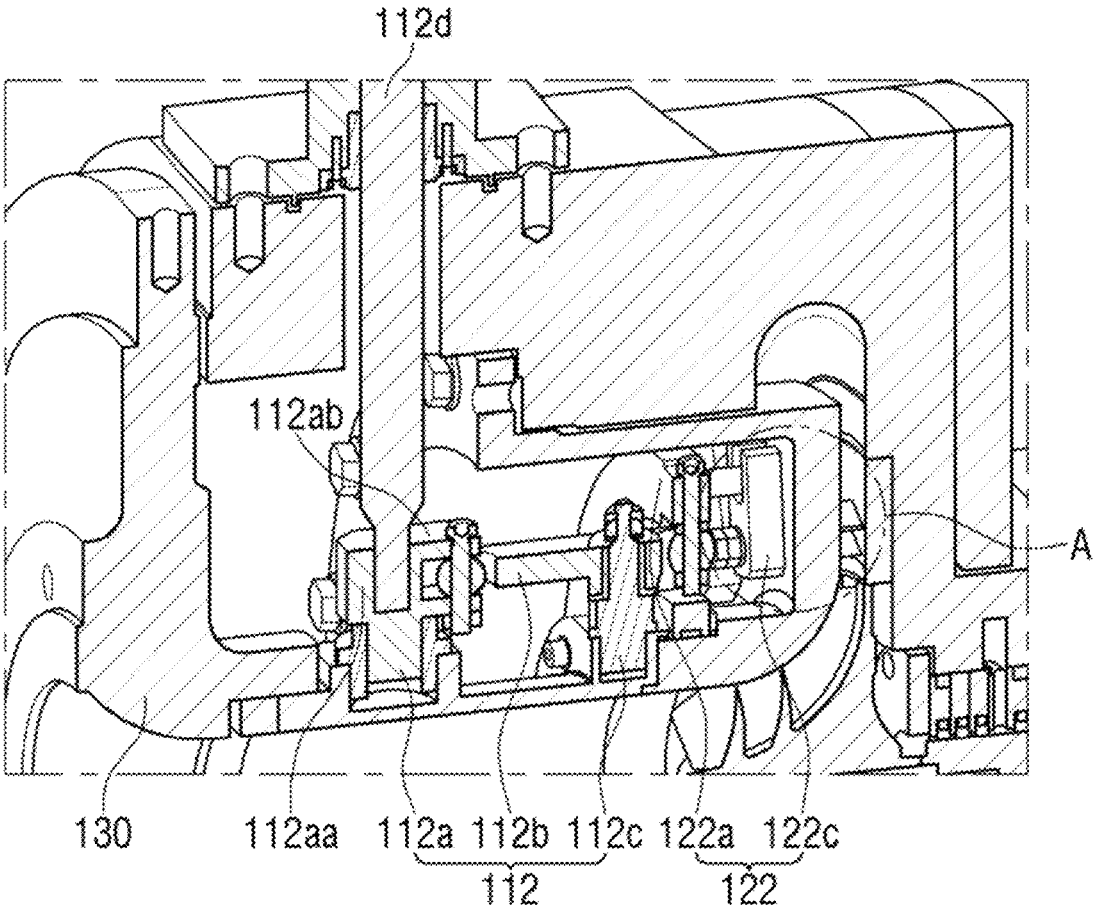
FIG. 11 is a cross-sectional perspective view illustrating how the first and second modules of FIGS. 7 and 8 are coupled.
Figure 12A:
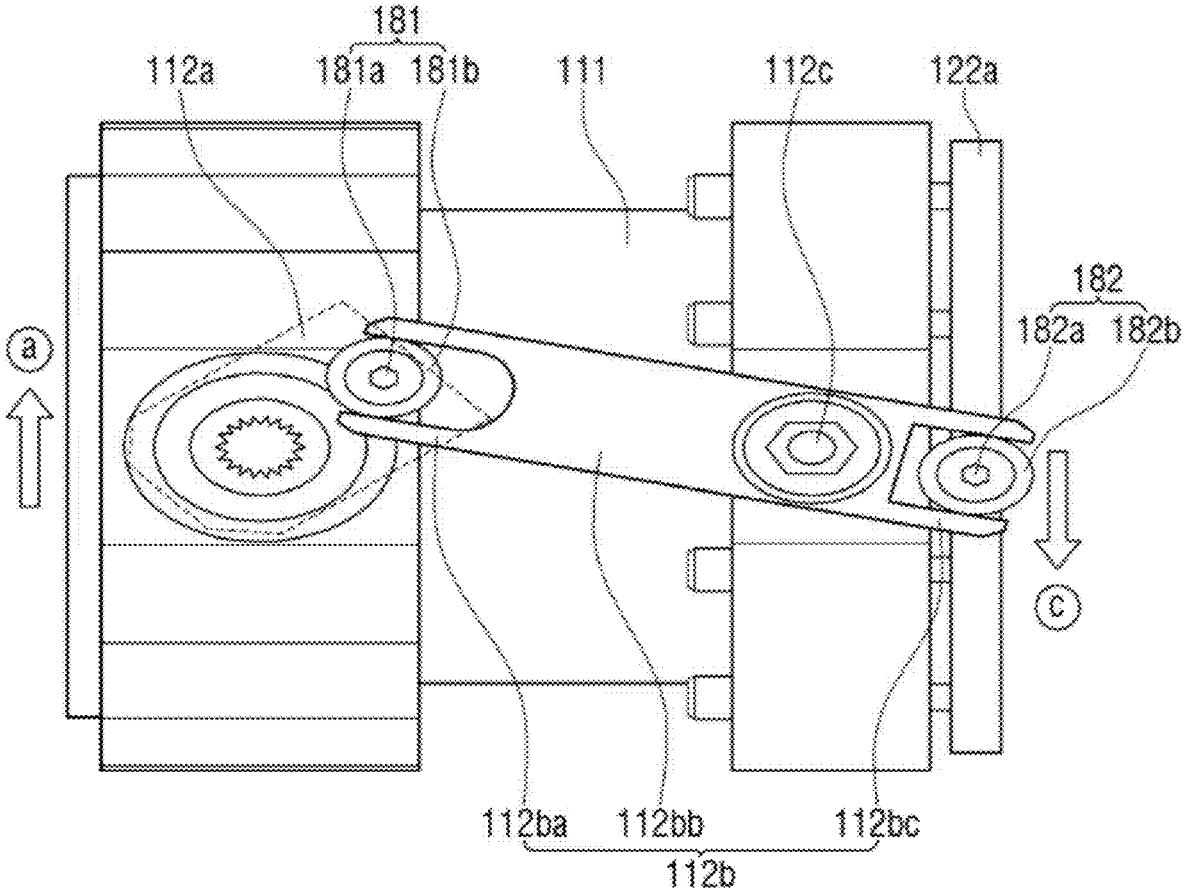
FIG. 12A is a first top view illustrating how the first and second links of the rotating device according to an embodiment of the present disclosure operate.
Figure 12B:
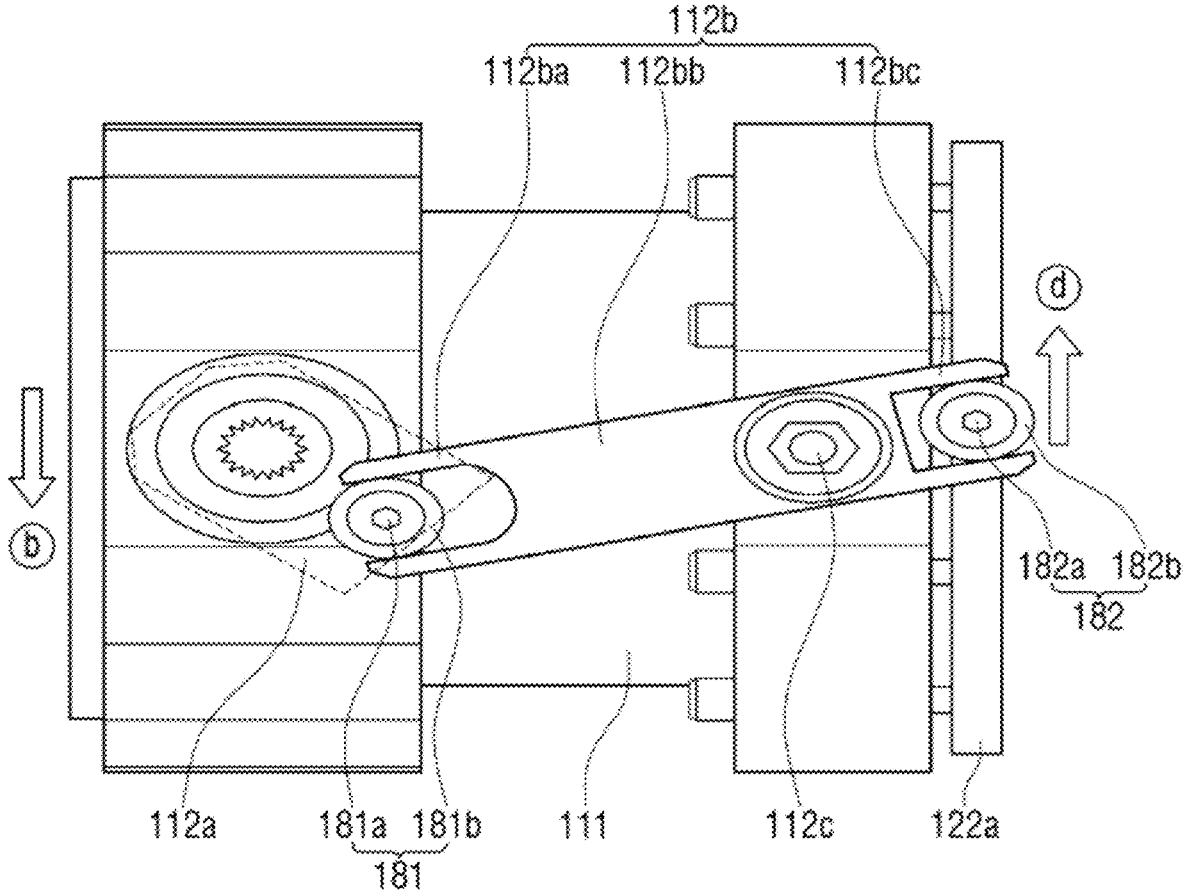
FIG. 12B is a second top view illustrating how the first and second links of the rotating device according to the embodiment of the present disclosure operate.
Figure 13:
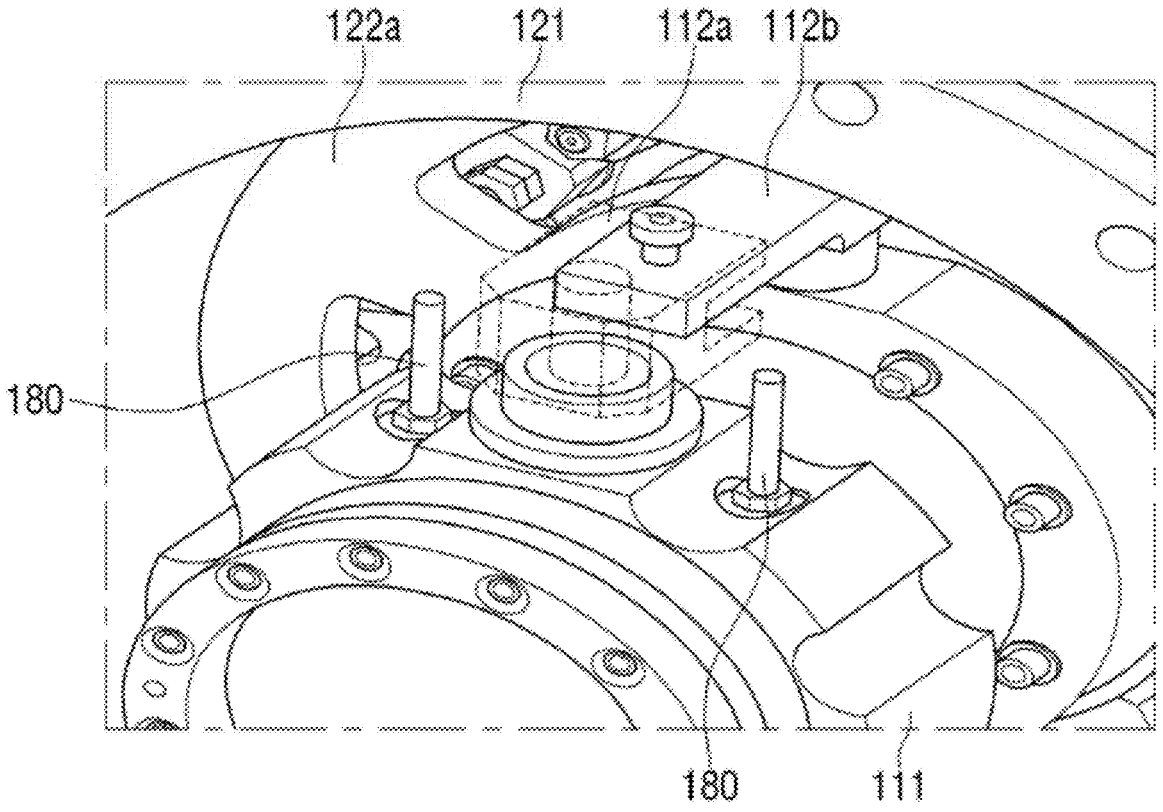
FIG. 13 is a partial enlarged view illustrating an upper part of a vane case of the rotating device according to an embodiment of the present disclosure.

FIG. 10 is a partial perspective view illustrating how the first and second links 112 and 122 are coupled. FIG. 11 is a cross-sectional perspective view illustrating how the first and second modules 110 and 120 are coupled. FIGS. 12A and 12B are top views illustrating how the first and second links 112 and 122 operate. FIG. 13 is a partial enlarged view illustrating an upper part of the vane case 111.

Referring to FIGS. 10 through 13, the first module 110 may include the vane case 111 and the first link 112.

The vane case 111 has already been described above, and the above description thereof may be directly applicable here.

The first link 112 is a component that is disposed at the 12 o'clock position on the outer circumferential surface of the vane case 111, receives the driving of the actuator 140, and delivers the driving of the actuator 140 to the second link 122. The first link 112 may include a main shaft 112*d*, a main link arm 112*a*, a control arm 112*b*, and a pivot 112*c*.

The main shaft 112*d* may be located at the top of the outer circumference of the vane case 111. The main shaft 112*d* may be disposed in a first direction to be connected to the actuator 140, which is provided to penetrate the housing 101 and the shroud case 121.

The main link arm 112*a* may be a component that is located at the top of the outer circumference of the vane case 111 and is connected and coupled to the main shaft 112*d*. The main link arm 112*a* is coupled to the main shaft 112*d* to extend in a second direction perpendicular to the first direction, i.e., in a horizontal direction from the front to the rear of the vane case 111. The main link arm 112*a* may be provided to be rotatable clockwise or counterclockwise vertically about the main shaft 112*d* in accordance with the driving of the main shaft 112*d*.

The main link arm 112*a* may include a body 112*aa* and a slot 112*ab*.

The body 112*aa* is connected to the main shaft 112*d* and rotates along with the main shaft 112*d*.

The slot 112*ab* may be provided to extend from the body 112*aa* in the second direction. The slot 112*ab* may be open at the end thereof in the second direction and may be formed to have an angular U shape in a cross-sectional view. The control arm 112*b* may be rotatably coupled into the slot 112*ab*, as illustrated in FIGS. 12A and 12B. In order to prevent the slot 112*ab* from interfering with the rotation of the control arm 112*b*, the slot 112*ab* may be formed to be open in an angular U shape.

A first rotation guide 181, in which the control arm 112*b*, particularly, one end of the control arm 112*b* (or an input end 112*ba* of the control arm 112*b*), is rotatably inserted, may be provided in the slot 112*ab*.

The first rotation guide 181 may include a first protrusion 181*a* and a first rotating ball 181*b*.

The first protrusion 181*a* may be formed vertically in the first direction between parts of the slots 112*ab*.

The first rotating ball 181*b* may be formed as a sphere around the first protrusion 181*a* and may be inserted into the input end 112*ba* of the control arm 112*b* to allow the input end 112*ba* of the control arm 112*b* to rotate.

Stoppers 180, which limit the rotation of the main link arm 112*a*, may be provided on both sides of the main link arm 112*a* at the top of the outer circumference of the vane case 111.

The stoppers 180 may protrude vertically upward from the outer circumference of the vane case 111. As the main link arm 112*a* rotates clockwise or counterclockwise in accordance with the rotation of the main shaft 112*d*, the stoppers 180 may come in contact with the main link arm 112*a* and may thus limit the rotation of the main link arm 112*a*.

The control arm 112*b* may be connected to the main link arm 112*a* and may be formed to extend in the second direction, i.e., in a rear direction from the vane case 111.

The control arm 112*b* may include a body 112*bb*, the input end 112*ba*, and an output end 112*bc*.

The body 112*bb* may be formed to extend in the horizontal direction, and the input and output ends 112*ba* and 112*bc* may be formed at the ends of the body 112*bb*. The input end 112*ba* is coupled to the slot 112*ab*, and the output end 112*bc* is coupled to the second link 122, particularly, to the control ring 122*a* that will be described later. The input and output ends 112*ba* and 112*bc* may be formed as rotation openings that can be rotatably coupled to the slot 112*ab* and the control ring 122*a*, respectively.

The rotation openings may be formed in a shape that is open in in a view in the first direction, i.e., in the shape of the set and subset symbols "⊃" and "⊂".

The first rotating ball 181*b* may be seated in the rotation opening of the input end 112*ba* to be rotatable. Also, a second rotation guide 182, particularly, a second rotating ball 182*b*, may be seated in the rotation opening of the output end 112*bc* to be rotatable. Thus, the input end 112*ba* of the control arm 112*b* may be rotatable clockwise or counterclockwise about the pivot 112*c* in accordance with the rotation of the main link arm 112*a*. Also, the output end 112*bc* of the control arm 112*b* may be rotatable clockwise or counterclockwise about the pivot 112*c* in accordance with the movement of the input end 112*ba*, and the output of the output end 112*bc* may be delivered to the control ring 122*a*.

The pivot 122*c* may be located at one end of the vane case 111, particularly, at the rear of the outer circumference of the vane case 111 in the 12 o'clock direction of the vane case 111, and may be coupled to the main link arm 112*a*, particularly, to a predetermined location on the body 112*bb*.

The control arm 112*b* may be coupled to the vane case 111 to be rotatable about the pivot 112*c*. The control arm 112*b* may rotate about the pivot 112*c* and may move in accordance with the driving of the main shaft 112*d*. Accordingly, as the input end 112*ba* moves in a direction a, the output end 112*bc* may move in a direction c, and as the input end 112*ba* moves in a direction b, the output end 112*bc* may move in a direction d.

Figure 14:
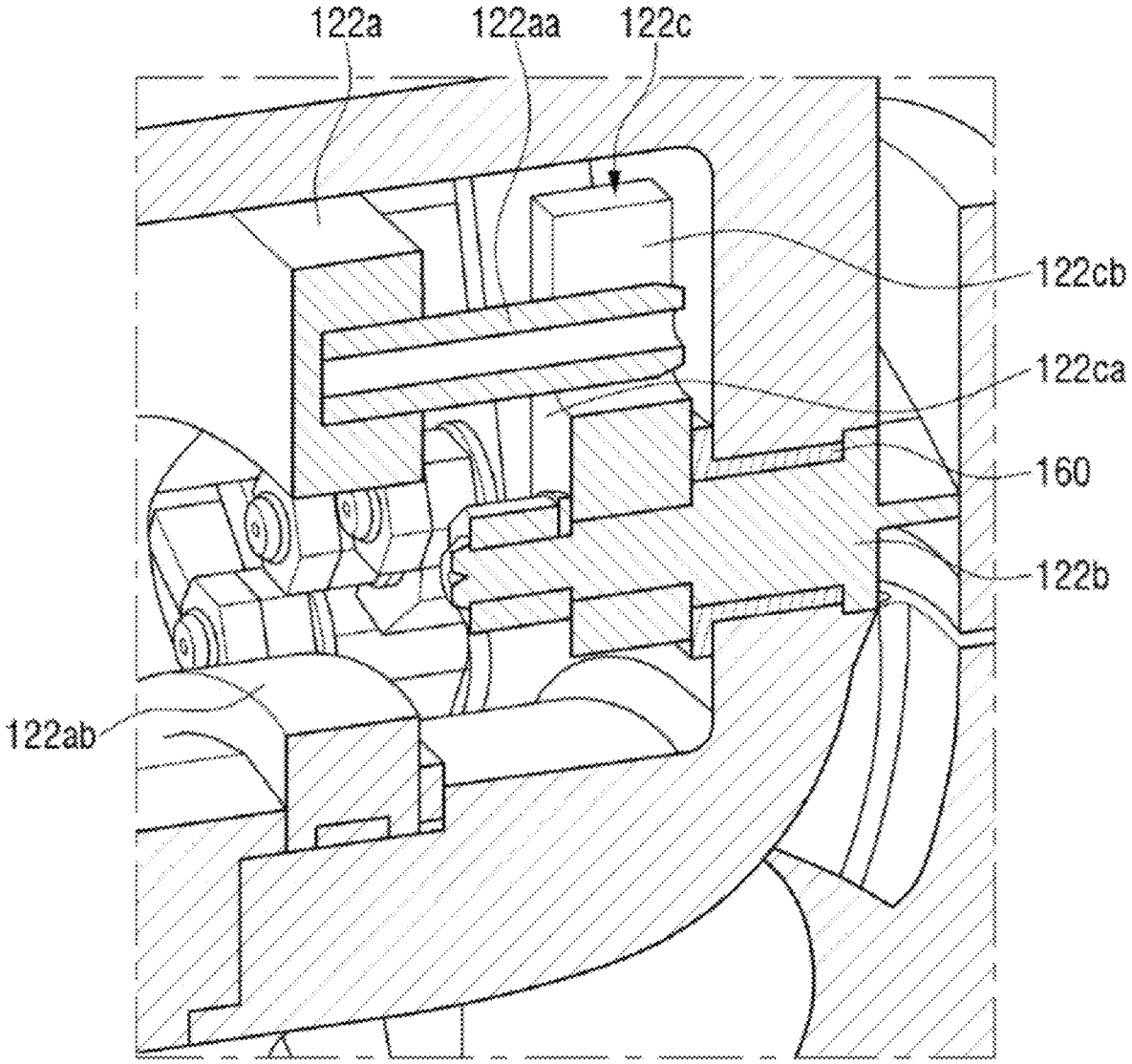
FIG. 14 is a partial cross-sectional perspective view illustrating how parts of the second module of the rotating device according to an embodiment of the present disclosure are coupled.
Figure 15:
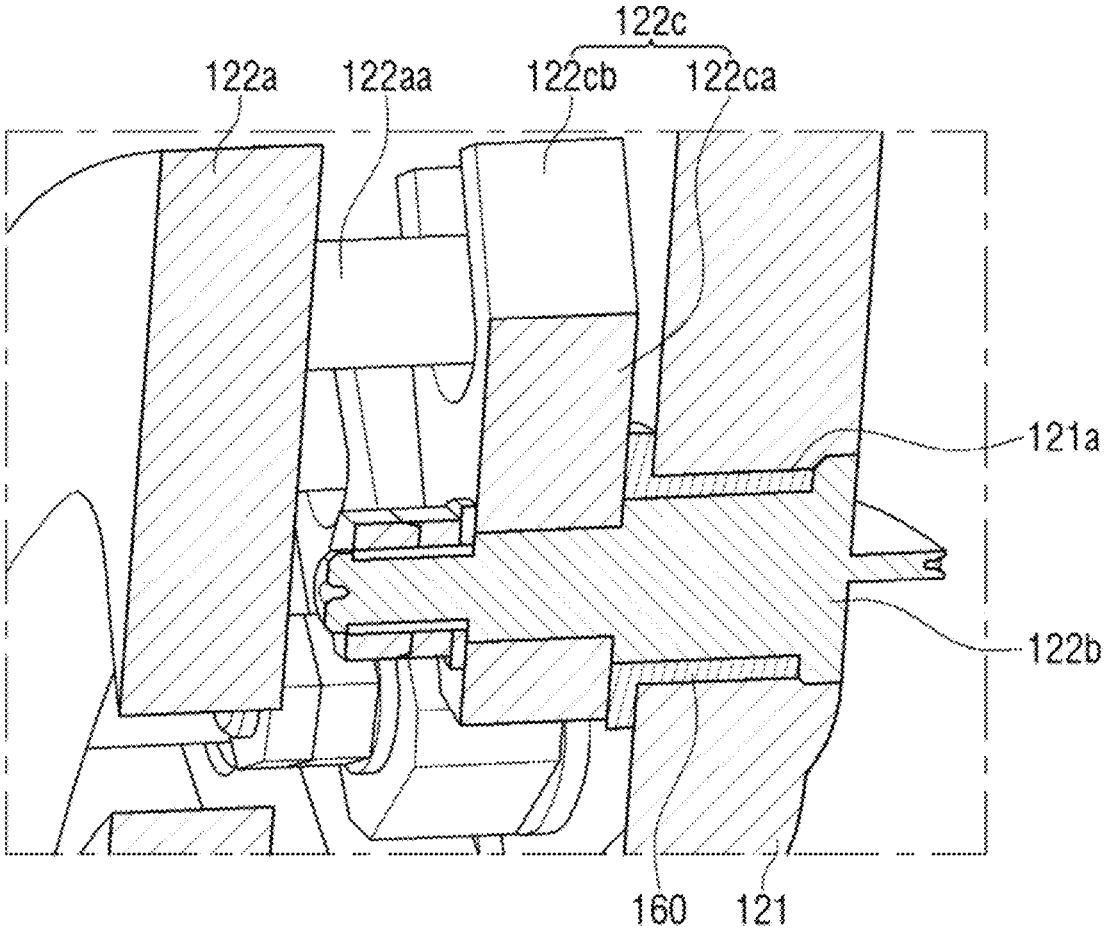
FIG. 15 is an enlarged cross-sectional view of a part A of FIG. 11.
Figure 16A:
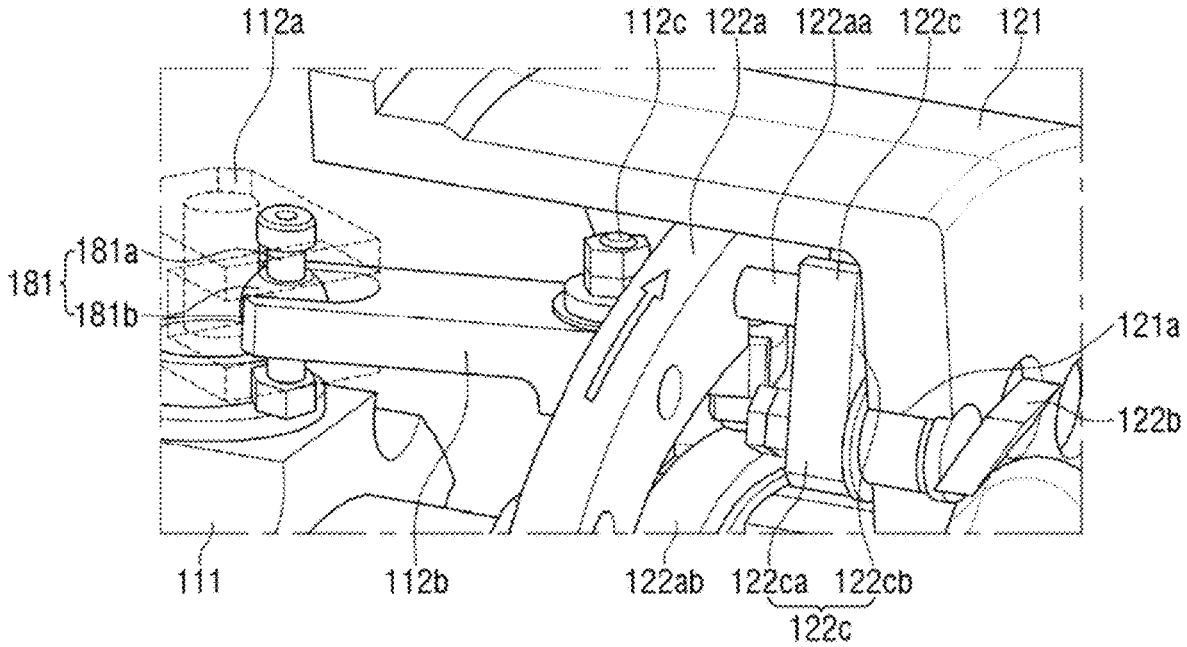
FIG. 16A is a first cross-sectional perspective view illustrating how the first and second links of the rotating device according to an embodiment of the present disclosure operate.
Figure 16B:
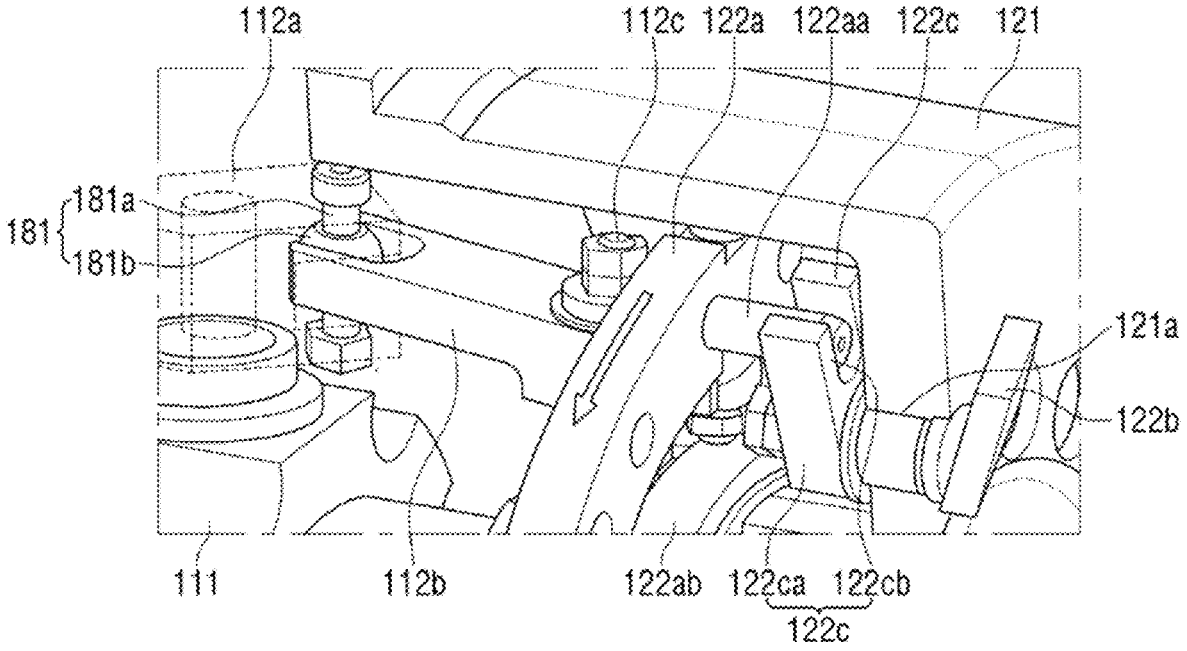
FIG. 16B is a second cross-sectional perspective view illustrating how the first and second links of the rotating device according to the embodiment of the present disclosure operate.
Figure 17:
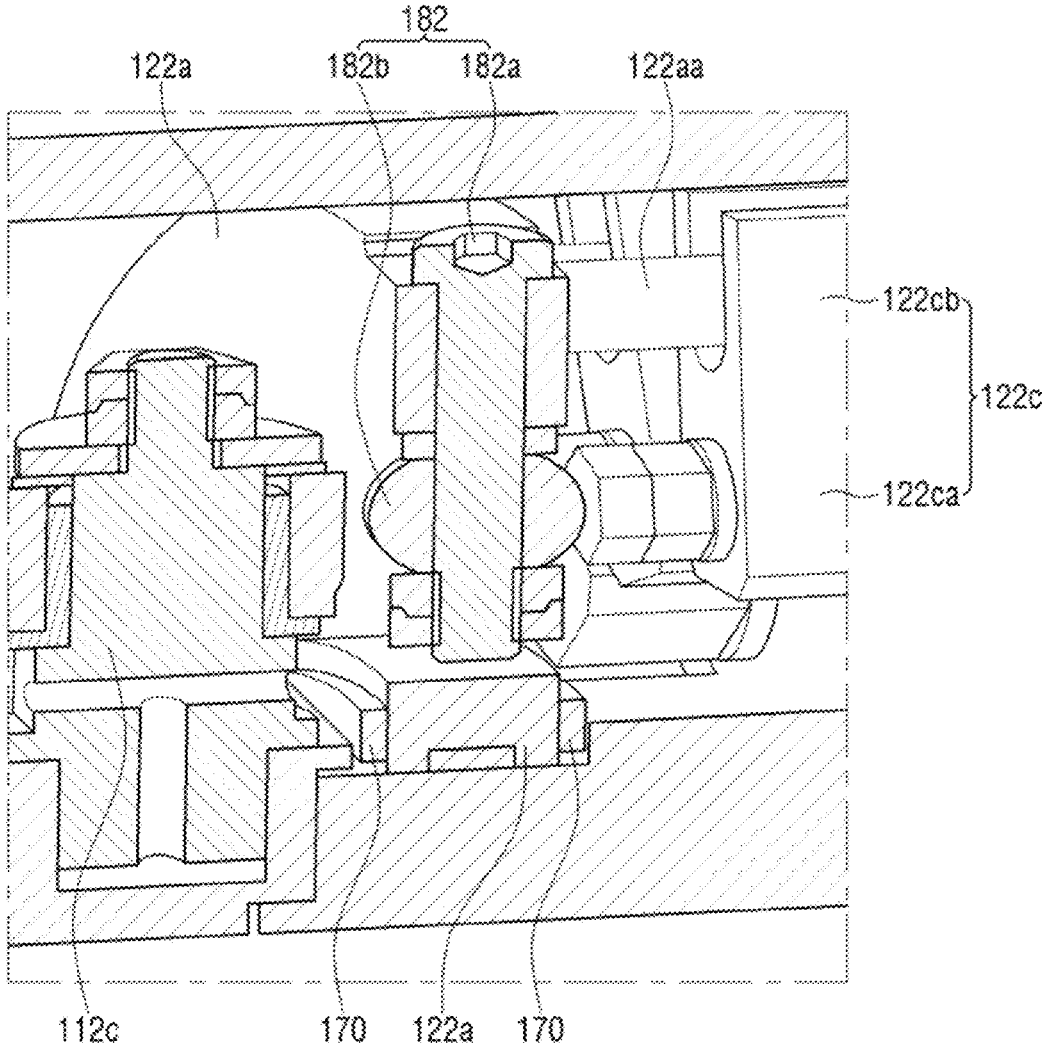
FIG. 17 is a partial cross-sectional perspective view illustrating how parts around a control ring of the rotating device according to an embodiment of the present disclosure are coupled.

FIG. 14 is a partial cross-sectional perspective view illustrating how parts of the second module 120 are coupled. FIG. 15 is an enlarged cross-sectional view of a part A of FIG. 11. FIGS. 16A and 16B are cross-sectional perspective views illustrating how the first and second links 112 and 122 operate. FIG. 17 is a partial cross-sectional perspective view illustrating how parts around the control ring 122*a* are coupled.

Referring to FIGS. 14 through 17, the second module 120 may include the shroud case 121 and the second link 122.

The shroud case 121 is a component that is formed in the shape of a hat and is coupled to the inside of the housing 101. The first module 110 may be received in, and coupled to, the shroud case 121 so that the first link 112 of the first module 110 and the second link 122 of the second module 120 may be coupled together.

One or more of a through hole 121*a* may be formed at the bottom of the shroud case 121 so that the vanes 122*b* may be exposed to the outside of the shroud case 121 and may be rotatably coupled to the shroud case 121. One or more bushings 160 for the rotation of the vanes 122*b* may be provided between the one or more of the through hole 121*a* and the vanes 122*b*.

The second link 122 is a component that receives a driving force from the first link 112 to be driven. Specifically, the second link 122 may include the control ring 122*a*, the vanes 122*b*, and the link 122*c*.

The control ring 122*a* may be located on the inside of the bottom of the shroud case 121 and may be coupled to the output end 112*bc* of the main link arm 112*a*. The control ring 122*a* may be provided to receive the output of the output end 122*bc* of the main link arm 122*a* and thus to rotate about the hollow space inside the shroud case 122. The control ring 122*a* is a component that receives the output of the output end 112*bc* of the main link arm 112*a* to rotate the vanes 122*b* and may be formed in the shape of a ring.

A plurality of guide grooves 122*ab* may be formed between the outer circumferential surface and the inner circumferential surface of the control ring 122*a* along the circumferential direction of the control ring 122*a*. For example, three guide grooves may be formed. At least one of the guide grooves, particularly, an upper guide groove 122*ab*, may be provided to have an end of the main link arm 112*a* (e.g., the output end 112*bc*) inserted thereinto, and a component coupled to the output end 112*bc*, for example, the second rotation guide 182, may be provided in the upper guide groove 122*ab*. The second rotation guide 182 may rotate the control ring 122*a* in accordance with the output of the output end 112*bc*.

As already mentioned above, the second rotation guide 182, which is a component that can receive the output of the output end 112*bc* due to the output end 112*bc* being inserted in one of the guide grooves 122*ab*, particularly, in the upper guide groove 122*ab*, may be provided in the upper guide groove 122*ab*.

The second rotation guide 182 may be provided to be able to be inserted in the output end 112*bc*, which is U-shaped, and may include a second protrusion 182*a* and the second rotating ball 182*b*.

The second protrusion 182*a* may be formed to protrude vertically from the 12 o'clock position of the upper guide groove 122*ab*.

The second rotating ball 182*b* may be formed as a sphere around the second protrusion 182*a* and may be inserted in the output end 112*bc* of the control arm 112*b* for the rotation of the control arm 112*b*.

A protruding pin 122*aa* may be formed on one surface of the control ring 122*a*, particularly, on a surface of the control ring 122*a* that faces the shroud case 121, to protrude from the control ring 122*a* toward the vanes 122*b*. The protruding pin 122*aa* may be inserted and coupled into a slot part 122*cb* of the link 122*c* and may thus be connected to the link 122*c*, which rotates the vanes 122*b*.

Sliding pads 170 may be provided on both sides of the circumferential surface of the central opening of the control ring 122*a*. As the sliding pads 170 are disposed at both sides of the control ring 122*a*, the control ring 122*a* can smoothly rotate. For example, the sliding pads 170 may be provided on respective surfaces of an inner radial side of the control ring for the rotation of the control ring.

The vanes 122*b* are components that are connected to the control ring 122*a* and are configured to have their orientation vary while being turned on and off depending on the rotation direction of the control ring 122*a*.

The link 122*c* is a component that is provided between the control ring 122*a* and the vanes 122*b* to deliver the rotation of the control ring 122*a* to the vanes 122*b*.

The link 122*c* may include a coupling 122*ca* and the slot part 122*cb*. The coupling 122*ca* may be coupled to the vanes 122*b*. The slot part 122*cb* may be provided to extend in the second direction from the coupling 122*ca* and thus to be connected to the control ring 122*a*, particularly, the protruding pin 122*aa*, which protrudes from the control ring 122*a*.

As already mentioned above, the VGV module 100M can be disassembled into the first module 110, which includes the vane case 111 with the first link 112, and the second module 120, which includes the shroud case 121 with the second link 122. Thus, the link coupling structure of the VGV module 100M can be identified by opening the housing cover 130. Also, since the actuator 140 is connected to the first and second links 112 and 122, the driving states of the first and second link 112 and 122 during the driving of the actuator 140 can be identified even with the housing cover 130 open.

While embodiments are described above, it is not intended that these embodiments describe all possible forms of inventive concepts of the present disclosure. Rather, the words used in the specification are words of description rather than limitation, and it is understood that various changes may be made without departing from the spirit and scope of the inventive concepts of the present disclosure. Additionally, the features of various non-limiting example embodiments may be combined to form further embodiments of the present disclosure.

What is claimed is:

1. A rotating device comprising:

a housing;

a variable guide vane module provided on a surface of the housing; and a housing cover coupled to the housing and covering the variable guide vane module, wherein the variable guide vane module is configured to be separable into at least a first module and a second module, and the first module and the second module are coupled to, or decoupled from, each other by a coupling, wherein the first module comprises a vane case that has a cylinder shape and that is provided in the housing, and a first link that is coupled on the vane case, wherein the second module comprises a shroud case that is seated between the housing and the vane case, and a second link that is provided in the shroud case and is configured to be driven in accordance with driving of the first link, wherein the housing cover is configured to expose an opening of the housing by being opened, such that the variable guide vane module being driven and a coupling state of the first link and the second link are identifiable through the opening of the housing from an outside of the rotating device, and wherein the first link comprises:

a main shaft, which is disposed in the housing in a first direction that is perpendicular to an extending direction of the vane case, a main link arm, which is coupled to the main shaft and is elongated in a second direction that is perpendicular to the first direction so as to be configured to rotate in accordance with rotation of the main shaft, a control arm, which is connected to the main link arm and is elongated in the second direction, and a pivot located between an input end and an output end of the control arm, and wherein the pivot directly attaches a portion of the control arm to one end of the vane case and rotatably supports the control arm such that the control arm is configured to rotate around the pivot.

2. The rotating device of claim 1, wherein the main link arm comprises:

a body, which is connected to the main shaft, and a slot, which extends in the second direction from the body.

3. The rotating device of claim 2, wherein the slot includes a recess that is open in the second direction so as to form an angular U shape.

4. The rotating device of claim 2, wherein the rotating device further comprises:

a first rotation guide that is provided in the slot and is inserted in the input end of the control arm, the first rotation guide configured to be rotated by the main link arm.

5. The rotating device of claim 4, wherein the first rotation guide comprises:

a first protrusion, which is provided within the slot, and a first rotating ball, which is formed around the first protrusion and allows a sliding rotation of the input end of the control arm.

6. The rotating device of claim 2, wherein the control arm comprises a body, and further comprises the input end and the output end which are provided at ends of the body, respectively, and the input end and the output end each include a rotation opening that couple to the slot and the second link, respectively.

7. The rotating device of claim 6, wherein the rotation opening of the input end and the rotation opening of the output end are open at the ends of the body of the control arm, and have a c-shape, respectively, when viewed in the first direction.

8. The rotating device of claim 6, wherein the second link comprises:

a control ring, which is configured to rotate about the pivot in accordance with rotation of the main link arm, a plurality of vanes, which are connected to the control ring, the control ring configured to vary orientations of the plurality of vanes by rotating, and a link, which is provided between the control ring and the plurality of vanes and configured to deliver rotation of the control ring to the plurality of vanes.

9. The rotating device of claim 8, wherein at least one guide groove, in which an end of the main link arm is inserted, is formed between an outer circumferential surface and an inner circumferential surface of the control ring, and a second rotation guide is provided in a guide groove of the at least one guide groove and rotatably inserted in the output end of the control arm.

10. The rotating device of claim 9, wherein the second rotation guide comprises:

a second protrusion, which is formed within the guide groove of the at least one guide groove, and protrudes from a surface of the guide groove, and a second rotating ball, which is formed around the second protrusion and allows rotation of the output end of the control arm.

11. The rotating device of claim 8, wherein the link comprises:

a coupling, which is coupled to the plurality of vanes, and a slot, which extends in the second direction from the coupling.

12. The rotating device of claim 11, further comprising:

a protruding pin provided on a surface of the control ring, the protruding pin protruding toward an inside of the shroud case and seated in the slot of the link.

13. The rotating device of claim 8, wherein at least one through hole is formed in the shroud case, the at least one through hole penetrated by the plurality of vanes such that the plurality of vanes are rotatably coupled to the shroud case, and the rotating device further comprises at least one bushing provided between the at least one through hole and the plurality of vanes.

14. The rotating device of claim 8, further comprising:

sliding pads provided on side surfaces of the control ring for the rotation of the control ring.

15. The rotating device of claim 9, wherein the output end of the control arm is configured to be provided around the second rotation guide such that the first link and the second link are interlocked when the first module is inserted into the shroud case.

16. The rotating device of claim 1, further comprising:

stoppers provided on the vane case on respective sides of the main link arm such that the stoppers are apart from each other, the stoppers configured to limit rotation of the main link arm.

17. The rotating device of claim 1, wherein an internal structure of the variable guide vane module and at least a portion of the first link and the second link are visible from the outside of the rotating device when the housing cover is separated from the housing.

18. A variable guide vane module comprising:

a first module, which comprises a vane case that has a cylinder shape, and a first link that is provided on the vane case; and a second module, which comprises a shroud case that is outside the vane case, and a second link that is provided in the shroud case and is configured to be driven in accordance with driving of the first link, wherein the variable guide vane module is configured to be separable into at least two modules, including the first module and the second module, and the first module is inserted the second module and the first module and the second module are coupled to, or decoupled from, each other by a coupling, and wherein the first link comprises:

a main shaft, which is disposed in a first direction that is perpendicular to an extending direction of the vane case, a main link arm, which is coupled to the main shaft and is elongated in a second direction that is perpendicular to the first direction so as to be configured to rotate in accordance with rotation of the main shaft, a control arm, which is connected to the main link arm and is elongated in the second direction, and a pivot located between an input end and an output end of the control arm, and wherein the pivot directly attaches a portion of the control arm to one end of the vane case and rotatably supports the control arm such that the control arm is configured to rotate around the pivot.

* * * * *